US005999777A

United States Patent [19]

Masuda et al.

[11] Patent Number: 5,999,777

[45] **Date of Patent: *Dec. 7, 1999**

[54] IMAGE FORMING APPARATUS CAPABLE OF TEMPORARILY BREAKING THE CONTACT BETWEEN THE DEVELOPER AND THE PHOTOSENSITIVE DRUM WITH USE OF ELECTRIC FIELD

[75] Inventors: Koji Masuda; Yuji Sakemi, both of Numazu; Takao Ogata, Susono; Kazuhiro Hasegawa, Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/989,030

[22] Filed: Dec. 11, 1997

[30] Foreign Application Priority Data

Dec. 11, 1996 [JP] Japan ..... 8-351855
Dec. 11, 1996 [JP] Japan ..... 8-351856

[51] Int. Cl.[6] ..... G03G 15/06

[52] U.S. Cl. ..... 399/222; 399/228; 399/235; 399/270; 399/271

[58] Field of Search ..... 399/235, 234, 399/228, 230, 270, 271, 39, 40, 231, 222, 290, 291, 267, 55

[56] References Cited

U.S. PATENT DOCUMENTS

| | | | |
|---|---|---|---|
| 4,777,107 | 10/1988 | Kurematsu et al. | 430/122 |
| 4,791,452 | 12/1988 | Kasai et al. | 399/235 |
| 4,844,008 | 7/1989 | Sakemi et al. | 399/270 |
| 5,294,967 | 3/1994 | Munakata et al. | 399/227 |
| 5,655,191 | 8/1997 | Furuya et al. | 399/270 |

*Primary Examiner*—William Royer
*Assistant Examiner*—William A. Noē
*Attorney, Agent, or Firm*—Fitzpatrick, Cella, Harper & Scinto

[57] ABSTRACT

An image forming apparatus includes an image bearing member for bearing an electrostatic latent image; a first developing device for developing the electrostatic latent image on the image bearing member; a second developing device, faced to the image bearing member and having a movable developer carrying member for carrying toner and carrier, for effecting development after a first developed image provided by the first developing device passes through a position where the developer carrying member is faced to the image bearing member; and a preventing device for forming an alternating electric field between the developer carrying member and the image bearing member, while the second developing device is at reset to prevent the carrier of the second developing device from rubbing the first developed image.

14 Claims, 7 Drawing Sheets

IMAGE FORMING APPARATUS CAPABLE OF TEMPORARILY BREAKING THE CONTACT BETWEEN THE DEVELOPER AND THE PHOTOSENSITIVE DRUM WITH USE OF ELECTRIC FIELD

FIELD OF THE INVENTION AND RELATED ART

The present invention relates to an image forming apparatus such as a copying machine or a printer, in particular, a color image forming apparatus with a plurality of developing devices.

FIG. 4 schematically illustrates a full-color digital copying machine. This copying machine comprises a photosensitive drum 1 as an image bearing member, and a developing apparatus 4 constituted of four developing devices 4Y, 4C, 4M, and 4K positioned adjacent to the peripheral surface of the photosensitive drum 1. The developing devices 4Y, 4C, 4M, and 4K are used for developing yellow, cyan, magenta, and black colors, correspondingly, and employ a contact type developing method which uses two component type developer composed of the mixture of nonmagnetic toner and magnetic carrier.

In the copying machine, first, an original 30 is read by a CCD 41. the obtained analog image signal is amplified to a predetermined level by an amplifier 42, and then is converted into an eight bit digital image signal (0–256 gradations) by an A/D converter 43. Next, this digital image signal is passed through a gamma converter 45 (converter which comprises 256 bytes of RAM, and carries out digital conversion based on a look-up system), being thereby subjected to a gamma correction process, and then is put into a D/A converter 46, in which it is converted into an analog signal. Then, this analog image signal is used as a modulating signal by a comparator 47 to modulate the pulse waves with a predetermined frequency, which is generated by a triangular wave generator circuit 49. As a result, a two-value image signal is obtained.

The thus obtained two-value signal is put directly into a laser driver circuit 50 to be used as a signal for turning on or off a laser diode 51. The laser beam emitted from the laser diode 51 is deflected by a commonly known polygon mirror 3*a*, transmitted through an f/θ lens 3*b*, deflected by a mirror 3*c*, so that it scans, in the primary scanning direction, the peripheral surface of the photosensitive drum 1 which is being rotated in the direction indicated by an arrow mark R1. As a result, an electrostatic latent image is formed on the peripheral surface of the photosensitive drum 1.

As for the photosensitive drum 1, first, the peripheral surface of the photosensitive drum 1 is uniformly discharged by an exposing device 11, and then is uniformly charged to negative polarity by a charger 2. Thereafter, the aforementioned electrostatic latent image is formed on the peripheral surface of the photosensitive drum 1 as it is exposed to the aforementioned laser beam. The electrostatic latent image on the peripheral surface of the photosensitive drum 1 is developed by one of the developing devices 4Y–4K which employ a commonly known reversal development system; in other words, negatively charged toner is adhered to the peripheral surface of the photosensitive drum 1, on the areas discharged by the laser beam, to develop the electrostatic latent image into a toner image. FIG. 5 shows the relationship between the surface polential level of the photosensitive drum 1 and the development contrast in the aforementioned reversal development.

In FIG. 5, a referential code $V_d$ refers the surface potential level of the photosensitive drum 1 immediately after the photosensitive drum 1 has been negatively charged by the charger 2; $V_{00}$ refers to the surface potential level of the photosensitive drum 1 correspondent to the surface areas exposed to a laser beam emitted from the laser when the laser is driven by an image signal which has been digitalized by the A/D converter 43. and has a value of 00H (0 level); and a referential code $V_{ff}$ means the surface potential level of the photosensitive drum 1 correspondent to the surface areas exposed to a laser beam emitted from the laser when the laser is driven by an image signal having a value of FFH (255 level). In order to develop the latent image, a compound development bias composed of a DC voltage of $V_{dev}$, and an AC voltage (for example, having a frequency of 2 kHz and a peak-to-peak voltage of 2 $kv_{pp}$), is applied to the developing sleeve of one of the developing devices 4Y–4K. As a result, the latent image is developed in proportion to the development contrast $|V_{dev}-V_{xx}|$.

Given that the optimal development contrast $|V_{dev}-V_{xx}|$ in FIG. 5 is $V_{cont}$, and the development density correspondent to $V_{cont}$ is $D_{max}$, it is evident that in order to obtain an image density in a range of 1.2–1.8, which is generally considered desirable, all that is necessary is to set a proper value for $V_{cont}$. The anti-fog potential $V_{back}$ in FIG. 5 is for perfectly preventing fog from appearing on the white areas of the developed image, that is, the image areas scanned by the laser beam when the intensity of the laser beam is correspondent to the image signal level of 00H (0 level).

Referring to FIG. 4, a toner image formed on the photosensitive drun 1 by negatively charged toner through the above described development process is transferred onto a transfer medium P (generally, a sheet of paper) held on the peripheral surface of a transfer drum 5*a*, by the function of a transfer charger 5*b*. The residual toner, or the toner which remains on the peripheral surface of the photosensitive drum 1 after the image transfer, is scraped away by a cleaner, and then, the photosensitive drum 1 is uses to repeat the above described image formation process. The above described image formation process is carried out for each color to superpose four color toner images on the transfer medium P so that a full-color image is formed on the transfer medium P.

However, since in the case of the image forming apparatus illustrated in FIG. 4, the developer on the development sleeve of each of the developing devices 4Y–4K is placed in contact with the photosensitive drum 1, there is a possibility of the occurrence of the so-called color mixture phenomenon. For example, when the first color toner image, for example, a yellow toner image, on the photosensitive drum 1 passes by the developing devices 4C–4K for the second to fourth colors, the developer from these developing devices 4C–4K comes in contact with the yellow toner image, and as a result, the developer for the second to fourth colors, that is, the cyan, magenta, and black toners transfers onto the yellow toner image, and also the yellow toner on the photosensitive drum 1 transfers onto the development sleeves of the developing devices 4C–4K. The cause of the color mixture phenomenon will be explained with reference to the potential model given in FIG. 6.

FIG. 6 is a schematic drawing which shows the relationship between the surface potential of the photosensitive drum 1 during the image formation for the first color, and the surface potential of the development sleeve of the developing devices 4*c*, 4M, and 4K which are used for the image formation for the second color and the colors thereafter. The surface potential of the photosensitive drum 1, correspondent to the image areas, reduces from $V_{00}$ to $V_{ff}$ as the photosensitive drum 1 is exposed for the image formation for the first color. Meanwhile, the surface potential of the development sleeve of each of the developing devices 4C–4K to be used for the image forming process for the second color and the colors thereafter becomes $V_{ss}$ due to the induction by the surface potential of the photosensitive drum 1.

As a result, when the first color toner image on the surface of the photosensitive drum 1 passes by the developing devices 4C–4K for the second color and colors thereafter, the developer on the development sleeve of each of the developing devices 4C–4K transfers onto the first color toner image on the photosensitive drum 1, on the areas having a potential level higher than $V_{ss}$; in other words, the color mixture occurs to the first color toner image on the photosensitive drum 1. Further, the color toner which is on the surface of the photosensitive drum 1, on the areas having a potential level lower than the $V_{ss}$, transfers onto the development sleeve of each of the developing devices 4C–4K; in other words, the color toner mixture occurs to the developing devices 4C–4K.

There is another problem, that while the first color toner image on the photosensitive drum 1 is passing by the development sleeves 4C–4K for the second color and the colors thereafter, it is rubbed by the developer on the development sleeve of each the developing devices 4C–4K, and as a result, streaks are made across the surface of the first color toner image, which effects streaks in the completed multicolor image. Further, where the second developing device and the developing devices thereafter, for example, the second developing device 4C, is the developing device for the first color, the electrostatic latent image formed on the photosensitive drum 1 for the first color must pass by the first developing device 4Y, and as it passes by the first developing device 4Y, it is rubbed, and thereby disturbed, by the developer on the development sleeve of the developing device 4Y. As a result, a streaky image is outputted just as a streaky image is outputted when the first developing device 4Y is the developing device for the first color.

As for a method for solving the above problems, there is a method, according to which the developing devices 4Y–4K are rendered removable, and the developing devices other than the one needed immediately are moved away from the photosensitive drum 1.

However, this method also has problems. For example, the apparatus structure becomes complicated, increasing the apparatus cost, and images are disturbed by the shocks which occur when the developing devices are removed or attached.

SUMMARY OF THE INVENTION

Accordingly, the object of the present invention is to provide an image forming apparatus in which a developed image is prevented from being rubbed by the carrier in the developer.

Another object of the present invention is to provide an image forming apparatus in which color mixture is prevented.

Another object of the present invention is to provide an image forming apparatus in which the contact between the carrier arid the peripheral surface of the photosensitive drum can be temporarily broken with the use of an electric field According to an aspect of the present invention, an image forming apparatus, which comprises an image bearing member for bearing an electrostatic latent image, and a plurality of developing devices which develop the electrostatic latent image formed on said image bearing member, and employ a developer holder which moves while holding carrier and toner, further comprises a means for preventing the toner image formed on said image bearing member from being rubbed by the carrier on the developer holders of said plurality of developing devices, wherein when any one of said plurality of developing devices is activated for image formation, the movement of the developer holders of the rest of said plurality of developing devices is temporarily held, and an alternating electric field is generated between said image bearing member and each of the developer holders which are not moving, to prevent the carrier on the developer holders which are not moving, from rubbing the image developed on said image bearing member by the active developing device.

According to another aspect of the present invention, an image forming apparatus, which comprises an image bearing member for bearing an electrostatic latent image, and a plurality of developing devices which develop the electrostatic latent image formed on said image bearing member, and employ a developer holder which moves while holding carrier and toner, further comprises a means for preventing the toner image formed on said image bearing member from being rubbed by the carrier on the developer holders of said plurality of developing devices, said means comprising a plurality of pairs of electrodes which are extended, one for one, along both edges of each of the development stations between said image bearing member and said plurality of developer holders, wherein when any one of said plurality of developing devices is activated for image formation, the movement of the developer holders of the rest of said plurality of developing devices is temporarily held, and an alternating electric field is generated between said image bearing member and each of the developer holders which are not moving, and also an alternating voltage is applied to said electrodes adjacent to the developer holders which are not moving, to prevent the carrier on the developer holders which are not moving, from rubbing the image developed on said image bearing member by the active developing device.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
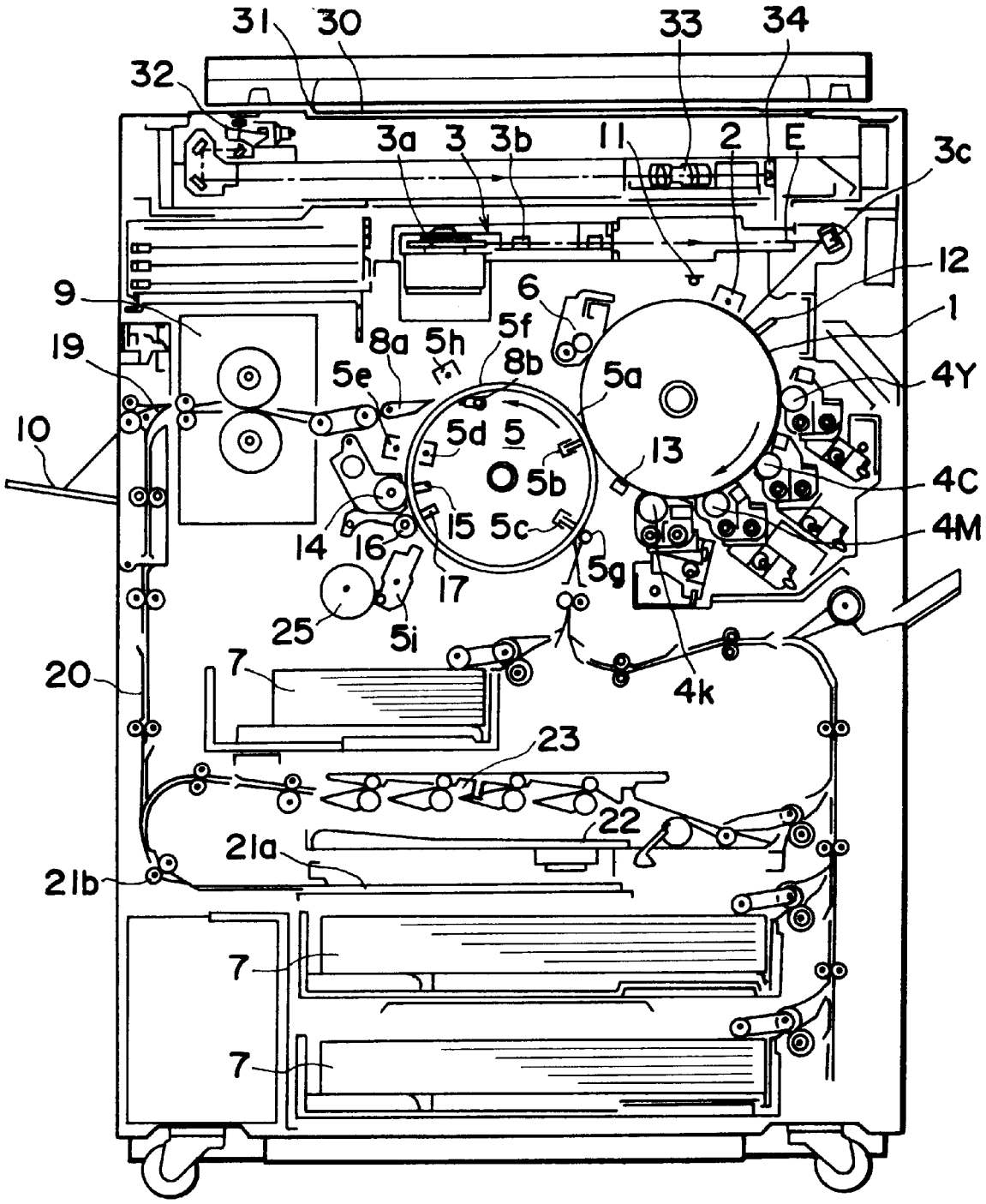
FIG. 1 is a section of the image forming apparatus in the first embodiment of the present invention, and depicts the general structure thereof.

FIG. 1 is a section of the image forming apparatus in the first embodiment of the present invention, and shows the general structure thereof. The image forming apparatus in this drawing has a digital color image reader section, which is located in the top portion of the apparatus, and a digital color printer section, which is located in the bottom portion of the apparatus.

In the reader section, an original 30 is placed on a original placement glass table 31, and the original 30 is exposed by an exposure lamp 32 in a scanning manner. The light reflected by the original 30 is focused by a lens 33 onto a full-color sensor 34, which separates the focused light into the primary colors of the original image, and outputs image signals correspondent to the separated primary colors. These signals are sent, through an amplifier (unillustrated), to a video processing unit (unillustrated), in which the signals are processed. Then, the processed signals are sent to the printer section.

In the printer section, the photosensitive drum 1, that is, the image bearing member, is supported in a manner to be rotatable in the direction of an arrow mark. The photosensitive drum 1 is surrounded by the aforementioned exposure lamp 11, a corona type charger 2, a laser based exposure optical system 3, a potential sensor 12, four developing devices 4Y, 4C, 4M, and 4K correspondent to the different primary colors, a means 13 for detecting the amount of light on the photosensitive drum 1, a transfer apparatus 5, and a cleaning device 6.

In the laser based exposure optical system 3, the image signals from the reader section are used to modulate the laser beam outputted from the laser section (unillustrated). The modulated laser beam is deflected by a polygon mirror 3*a*, passed through a lens 3*b*, deflected by a mirror 3*c*, and projected on the peripheral surface of the photosensitive drum 1.

Also in the printer section, the photosensitive drum 1 is rotated in the direction of the arrow mark, and while being rotated, it is discharged by the exposure lamp 11. Then, it is uniformly charged by the charger 2. Next, an optical image E correspondent to one of the primary colors is projected on the peripheral surface of the photosensitive drum 1. As a result, a latent image is formed on the peripheral surface of the photosensitive drum 1.

Next, one of the developing devices, which contains the color toner correspondent to the projected optical image E, is activated to develop the latent image on the photosensitive drum 1 through a commonly known reversal development process. As a result, an image is composed of resin based toner, on the photosensitive drum 1; in other words, a toner image is formed on the photosensitive drum 1. Meanwhile, a recording medium is conveyed from a recording medium cassette 7 to the transfer apparatus 5 by a conveyer system. In the transfer apparatus 5, the recording medium is conveyed through the image transfer section right next to the photosensitive drum 1, and while the recording medium is conveyed through the image transfer section, the toner image on the photosensitive drum 1 is transferred onto the recording medium.

The transfer apparatus 5 in this embodiment comprises a transfer drum 5*a*. Around the transfer drum 5*a*, a transfer charger 5*b*, an adherence charger 5*c*, an adherence roller 5*g* which is a backup roller for the adherence charger 5*c*, an inside charger 5*d*, an outside charger 5*e*, and the like, are disposed. The transfer drum 5*a* is axially supported so that it can be rotatively driven. More specifically, it comprises a cylindrical structural frame, and a sheet 5*f*, as a recording medium holder, which is stretched in a manner to cover the peripheral opening of the cylindrical frame. As for the material for the recording medium holding sheet 5*f*, inductive film, for example, polycarbonate film, is used. The recording medium is electromaynetically adhered to the surface of the recording medium holding sheet 5*f* by the functions of the adherence charger 5*c* and the adhesion backup roller 5*g*. As the transfer drum 5*a* is rotatively driven, the recording medium is repeatedly passed through the image transfer section.

As the photosensitive drum 1 is rotated, the toner image on the photosensitive drum 1 is moved into the image transfer section. In the image transfer section, the toner image is transferred onto the recording medium, which is being conveyed through the image transfer section in synchronism with the photosensitive drum 1 by the transfer drum 5*a*, by the function of the transfer charger 5*b*. The above described image forming sequence is carried out for each of the rest of the primary colors. As a result, a plurality (four in this embodiment) of color toner images are superposed on the recording medium held on the transfer drum 5*a*; in other words, a full-color image is created on the recording medium.

After the four color toner images correspondent to the four primary colors are transferred onto the recording medium, the recording medium is separated from the transfer drum 5*a* by the functions of a separation claw 8*a*, a roller 8*b* which pushes the recording medium to separate it from the transfer drum 5*a*, and the separation charger 5. The recording medium separated from the transfer drum 5*a* is sent to a thermal roller type fixing device 9, in which the toner image is fixed, completing a single-sided full-color print. Then, when the apparatus is in a single-sided printing mode in which a full-color image is created on only one side of a reconding medium, the single-sided full-color print is discharged into a delivery tray 10. After the toner image transfer, the photosensitive drum 1 is cleaned; the toner particles remaining on the peripheral surface thereof are cleaned off by the cleaning device 6. Then, the photosensitive drum 1 is used for the next image formation cycle.

On the other hand, in a double-sided full-color printing mode, in which a full-color imagines formed on both surfaces of d recording medium, the recording medium is not immediately discharged into the delivery tray 10. More specifically immediately after the recording medium comes out of the fixing device 9, the conveyance path switching guide 19 is activated to direct the recording medium to a vertical conveyance path 20, through which the recording medium is sent into a turning path 21*a*. After the recording medium is sent into the turning path 21, a turning roller 21*b* is rotated in reverse. As a result, the recording medium is backed out of the turning path, with the edge, which is the trailing edge when the recording medium is sent into the turning path 21*a*, becoming the leading edge. The backed out recording medium is temporarily stored in an intermediary tray 22. Then, the recording medium is sent from the intermediary tray 22 to the transfer drum 5*a* for the second time. Thereafter, a full-color image is formed on the second side of the recording medium through the aforementioned image forming process, finishing a double-sided full color copy.

In order to prevent powdery foreign matter from adhering to the recording medium holding sheet 5*f* of the transfer drum 5*a*, and also in order to prevent oil from adhering to a recording medium, the recording medium holding sheet 5*f* is cleaned by the functions of a fur brush 14, a backup brush 15 for the fur brush 14, an oil removal roller 16, and a backup brush 17 for the oil removal roller 16, which are disposed in contact with the recording medium holding sheet 5*f*. This cleaning of the recording medium holding sheet 5*f* is carried out before or after the start of image formation, and also is optionally carried out after a paper jam.

In the image forming apparatus in this embodiment, the size of the gap between the recording medium holding sheet 5*f* and the photosensitive drum 1 can be optionally set by moving a cam follower 5*i* integral with the transfer drum 5*a*, more specifically, by moving, with desired timing, an eccentric cam 25 which moves the cam follower 5*i*. For example, when the image forming apparatus is on standby, or an electric power source is off, the gap between the transfer drum 5*a* and the photosensitive drum 1 is increased.

In this embodiment of the present invention, the color mixture or the like is prevented by carrying out the following unique developing process during the preliminary rotation of the photosensitive drum 1, that is, the rotation of the photosensitive drum 1 immediately before the aforementioned image forming processes for four primary colors, in other words, before starting the image forming process for each color. Hereinafter, the unique process carried out during the rotation of the photosensitive drum 1 immediately before starting of the image forming process for each color will be described.

In the development process carried out prior to an actual image forming operation for, for example, a yellow color, the development sleeves of the developing devices, the second, third, and fourth developing devices 4C, 4M, and 4K for the cyan, magenta, and black colors, correspondingly, other than the first developing device 4Y for the yellow color, to be used for the immediate image formation process, are not rotated, and compound bias composed of a DC voltage of −350 V, and a AC voltage having a frequency of 2 kHz and a peak-to-peak voltage of 2 $kV_{pp}$, is applied to these stationary image developing devices. As for the photosensitive drum 1 which is rotated, the surface potential thereof is uniformly maintained at a predetermined level of −470 V.

Figure 2:
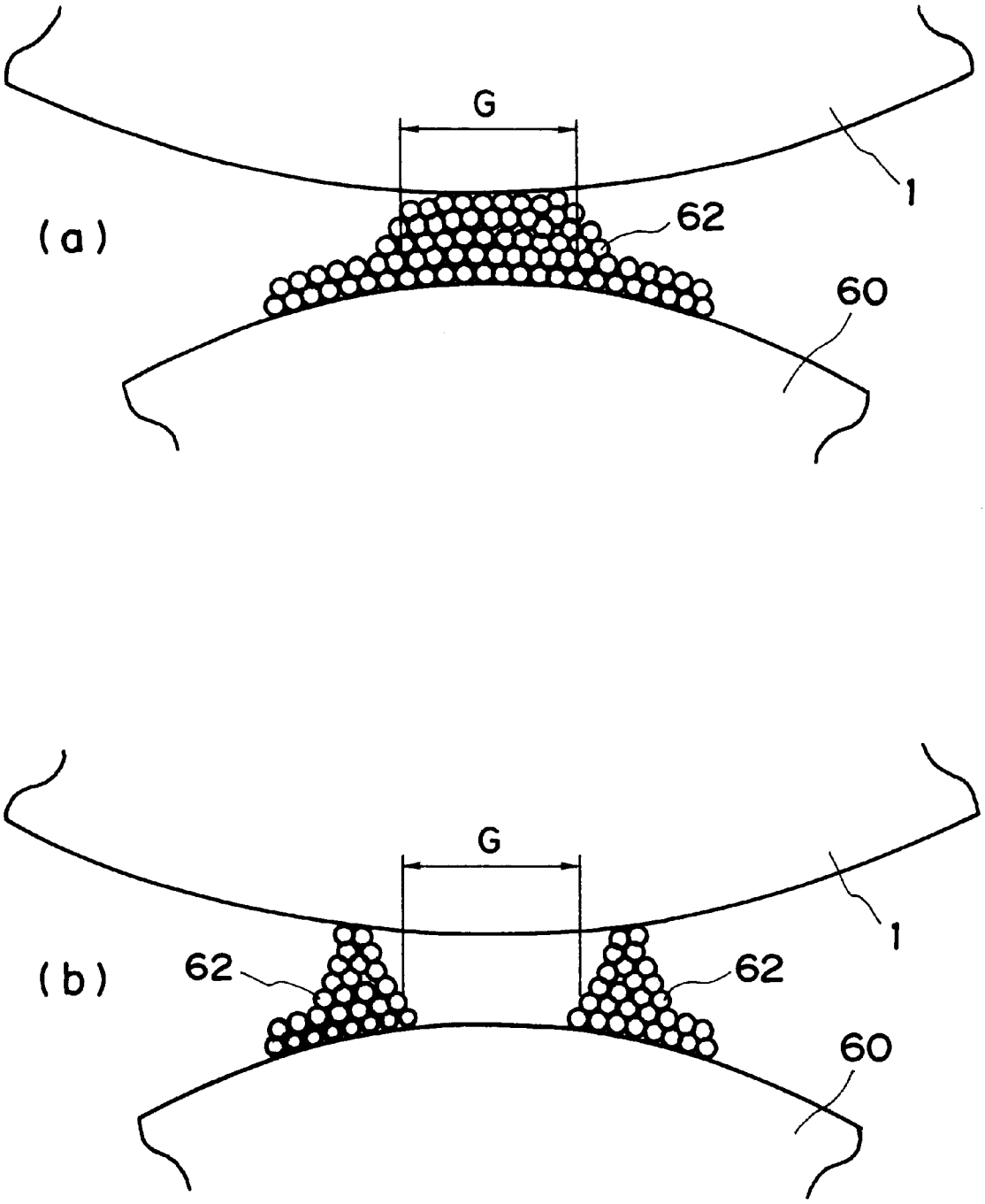
FIGS. 2(*a*) and (*b*) are schematic sections of the development nip and the adjacencies thereof, and depicts a phenomenon that the development nip is cleared of developer by the application of bias to the development sleeve.
Figure 3:
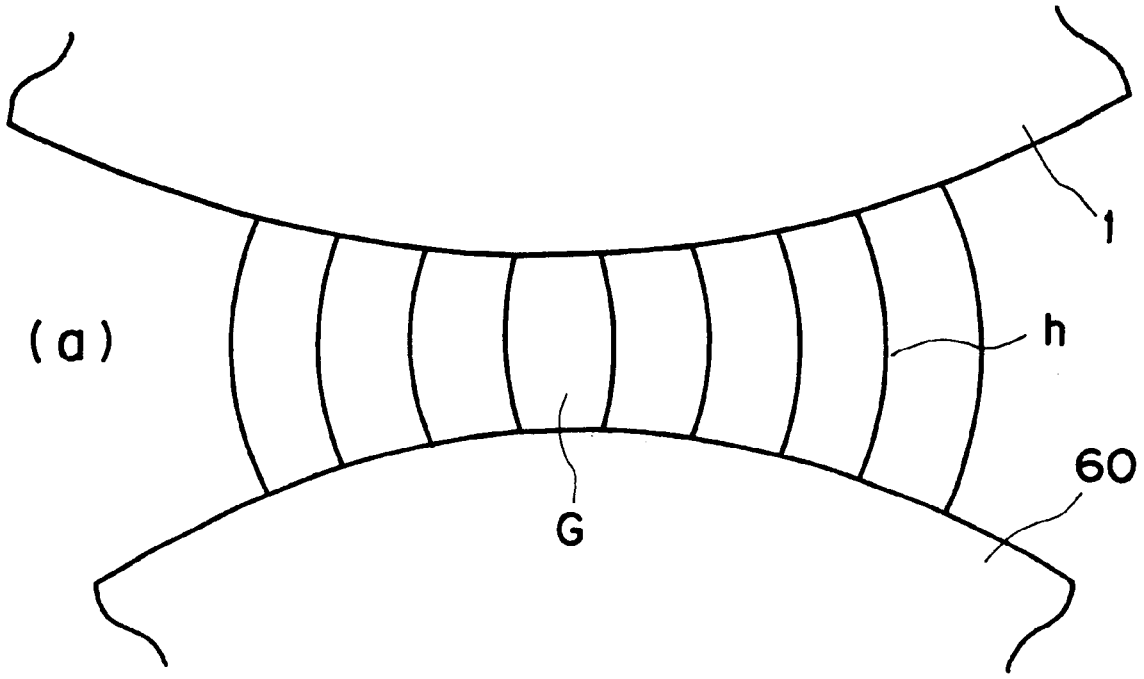
FIGS. 3(*a*) and (*b*) are schematic drawings which depicts the mechanism through which the development nip is cleared of developer by the application of bias to the development sleeve.
Figure 3:
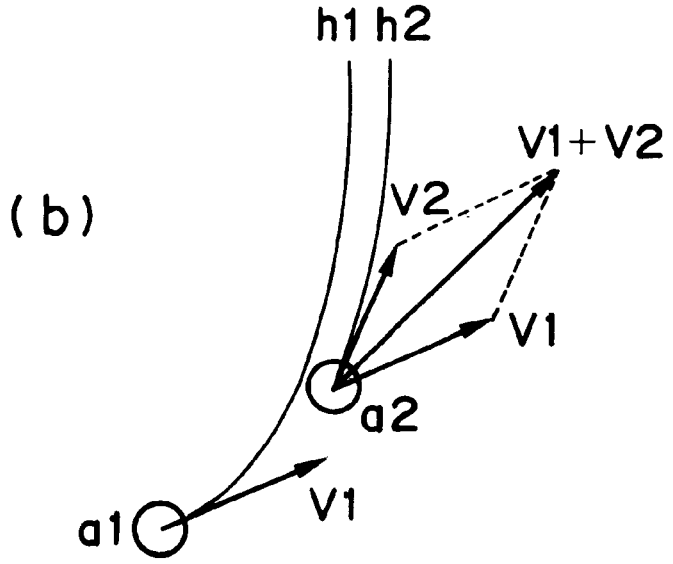
Figure 4:
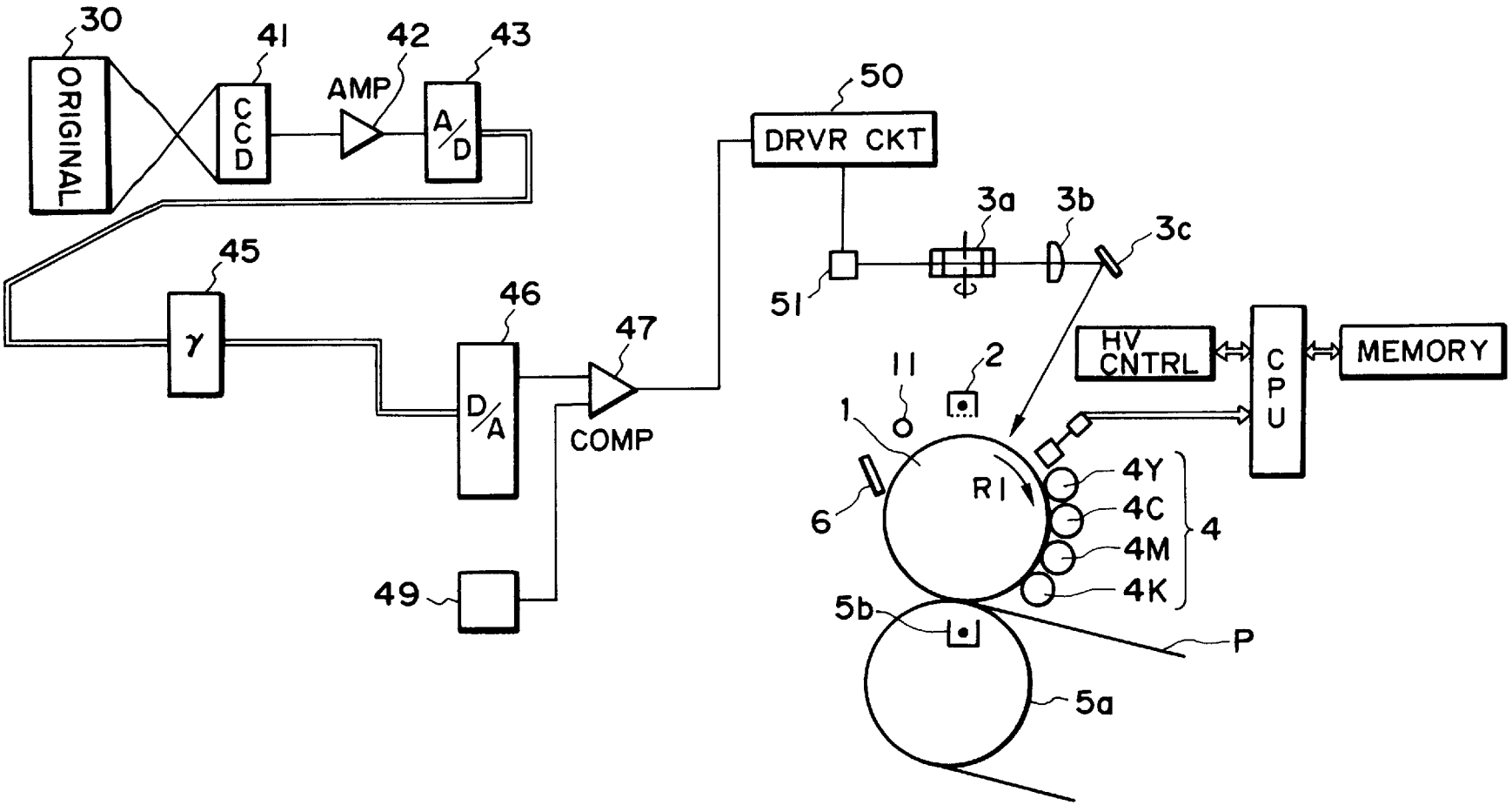
FIG. 4 is a schematic drawing which depicts the general structure of an image forming apparatus.
Figure 5:
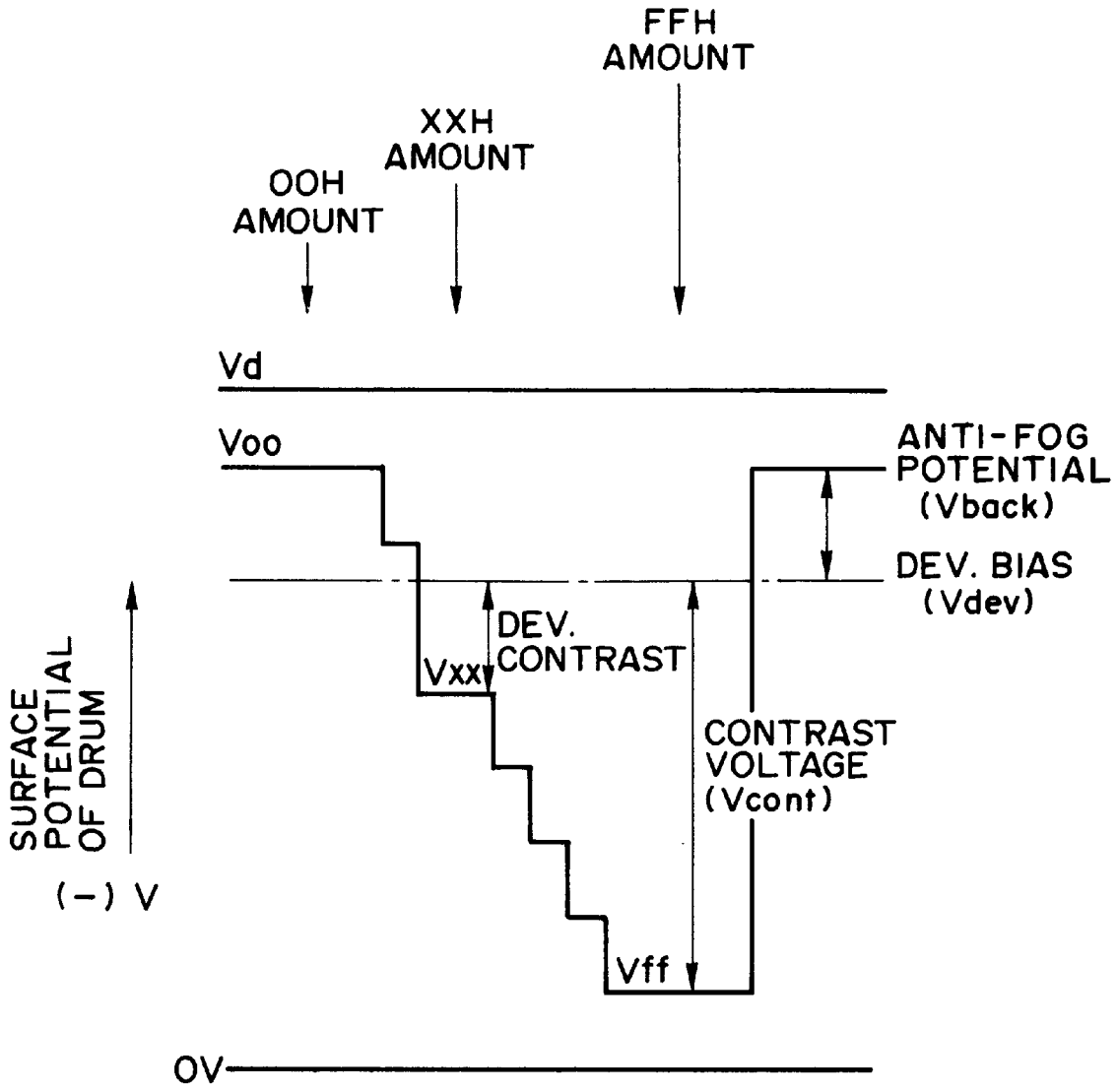
FIG. 5 is a schematic drawing which conceptually depicts the image development in the image forming apparatus illustrated in FIG. 4.
Figure 6:
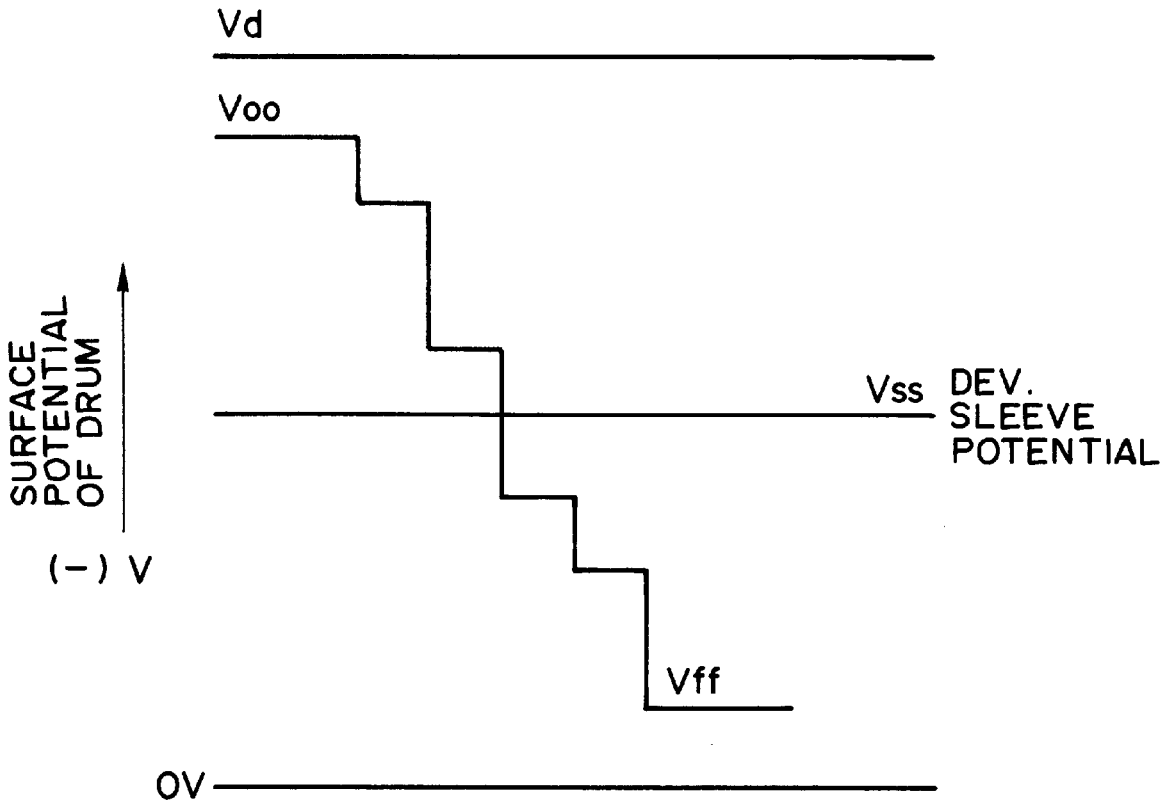
FIG. 6 is a schematic drawing which conceptually depicts the cause of the color mixture phenomenon, in conjunction with the drawing in FIG. 5.

Referring to FIG. 2(*a*), the developer particles 62, inclusive of both toner and magnetic carrier particles, on the development sleeve 60 of each of the image developing devices for the second color and the colors thereafter repeatedly shuttle between the photosensitive drum 1 and development sleeve 60 due to the alternating electric field induced by the above described compound voltage. Referring to FIG. 3(*a*), since the curvatures of both the photosensitive drum 1 and the development sleeve 60 which face each other are convex, the electrical field represented by lines h is substantially straight in the immediate adjacencies of the development nip G, but is distorted outward as the distance from the development nip G increases.

Referring to FIG. 3(*b*), in the region in which the electric field is distorted outward as depicted by a line $h_1$, when the developer is at the point al of the line $h_1$, it receives such electrical force that gives the developer a vector velocity of $V_1$ tangent to the line $h_1$, and when it is at a point $a_2$ on the line $h_2$, it receives such electrical force that gives the developer a vector velocity of $V_2$ tangent to the line $h_2$. Therefore, as the developer rapidly moves from the point $a_1$ to the point $a_2$, it is subjected to such force that gives it a vector velocity ($V_1$+$V_2$), that is, a vector velocity composed of the vectui velocities $V_1$ and $V_2$. Therefore, the trajectory of the developer particle at the point $a_2$ deviates outward from the direction of the vector velocity $V_2$.

In other words, when the developer particles move from the development sleeve 60 to the photosensitive drum 1, they always deviate in the direction away from the center of the development nip G while moving in the direction from the development sleeve 60 to the photosensitive drum 1 This is also true when the developer particles shuttle back from the photosensitive drum 1 to the development sleeve 60; they always deviate in the direction away from the center of the development nip G while moving toward development sleeve 60 from the photosensitive drum 1. As a result, while the photosensitive drum 1 is rotated prior to the start of an actual image forming process, the developer particles 62 on the development sleeve 60 move out of the development nip G, from both ends, in the direction of the circumference of the development sleeve 60, and by the time the preliminary rotation of the photosensitive drum 1 is over, there are almost practically no developer particles 62 in the development nip G (region in which the photosensitive drum 1 can be developed by toner), as illustrated in FIG. 2(*b*).

As described above, in this embodiment, the developer particles 62 on the development sleeve 60 of each of the developing devices 4C–4K for the second color and the colors thereafter are removed from the development nip G during the preliminary rotation of the photosensitive drum 1, and then, the image formation for the first color is started. Consequently, when the first color toner image formed on the photosensitive drum 1 passes by the developing devices tor the second color and the colors thereafter during the image formation for the first color, the developer particles on the development sleeve 60 of each of the developing devices for the second color and the colors thereafter do not mix into the color toner image on the photosensitive drum 1; neither do the color toner particles of the first color toner image on the photosensitive drum 1 mix into the developer on each of the developing devices for the second color and the colors thereafter. In addition, it is possible to prevent the occurrence of image anomaly attributable to the rubbing of the toner image for the first color by the magnetic carrier of the developer for the second color and the colors thereafter.

Further, when the second developing device 4C, for example, is the developing device for the first color, the developer particles 62 on the development sleeve 60 of the first developing device 4Y are removed from the development nip G also during the preliminary rotation of the photosensitive drum 1, and therefore, the electrostatic latent image formed on the photosensitive drum 1 for the first color can be prevented from being disturbed by the magnetic carrier while the latent image passes by the developing device 4Y, hence the image anomaly traceable to the disturbed electrostatic latent image can be prevented.

Thus, according to the present invention, image anomaly such as color mixture or streakiness can be easily prevented with low cost, and therefore, high quality prints can be reliably produced for a long time.

Embodiment 2

According to the first embodiment, during the preliminary rotation of the photosensitive drum 1, compound voltage composed of DC voltage and AC voltage is applied to the development sleeves of the developing devices for the second color and the colors thereafter, that is, all the developing devices except for the developing device for the first color, while keeping them stationary. For example, when the first developing device 4Y for the yellow color is the one to be immediately used the compound voltage composed of DC voltage and AC voltage is applied to the rest of the developing devices, that is, the second, third, and fourth developing devices 4C, 4M, and 4K for the cyan, magenta, and black colors, correspondingly, while keeping them stationary.

In this embodiment, in addition to implementing the method described in the first embodiment, such a DC voltage that is larger in absolute value than the surface potential of the photosensitive drum 1 which is being used for the image formation for the first color, and that is the same in polarity as the toner tor the first color, is applied to the development sleeves of the developing devices for the second color and the colors thereafter, while still keeping the development sleeves stationary, during the image formation. For example, when the polarity of the toner charge is negative, and the surface potential of the image areas on the photosensitive drum 1 is −100 V, the DC voltage to be applied to the development sleeves which are not being rotated is −300 V.

With the above arrangement even if toner particles are scattered from the toner image formed on the photosensitive drum 1 during the image formation for the first color, and float adjacent to the development sleeves of the developing devices for the second color and the colors thereafter, the floating toner particles are prevented from mixing into the toners of the developing devices for the second color and the colors thereafter. Therefore, the color mixture prevention in this embodiment is more effective than that in the first embodiment.

Embodiment 3

In this embodiment, after the image formation for each of the four colors, the photosensitive drum 1 is idled, and during this idling, or post-rotation, of the photosensitive drum 1, an electrostatic latent image which has a predetermined level of potential, that is, −150 V in this embodiment, is formed on the photosensitive drum 1. Then, a compound development bias composed of a DC voltage of −350 V, and an AC voltage having a frequency of 2 kHz and a peak-to-peak voltage of 2 $kV_{pp}$, is applied to the development sleeves of the developing devices other than the one just finished being used for the image formation.

According to this arrangement, even if there occurs a situation in which the color mixture prevention method described in the first or second embodiment cannot prevent all the toner particles of the toner image for the first color on the photosensitive drum 1 from transferring onto the development sleeves of the developing devices for the second color and the colors thereafter, the toner particles which have transferred onto the development sleeves of the developing devices for the second color and the colors thereafter are transferred back onto the photosensitive drum 1 through the development process; in other words, the developing devices for the second color and the colors thereafter are protected from color mixture through an additional step described in this third embodiment. Therefore, color mixture is even more effectively prevented.

Since the color toner particles which have been transferred back onto the photosensitive drum 1. are removed from the photosensitive drum 1 by the cleaning device 6, they do not cause any problem as far as the image formation on the following recording medium.

Thus, according to this embodiment, anomalies such as color mixture or streakiness can be even more effectively prevented for a long time.

Embodiment 4

This embodiment is substantially the same as the preceding embodiment, except for one small detail. For example, when the developing device 4Y for yellow color, the first color, is the one to be immediately used, the development sleeves of the developing devices 4C, 4M, and 4K for the second, third, and fourth colors, correspondingly, are not rotated, and a compound voltage, which is composed of a DC voltage of −350 V, and an AC voltage having a frequency of 2 kHz and a peak-to-peak voltage of 2 $kV_{pp}$, is applied to these stationary development sleeves. Meanwhile, the surface potential of the photosensitive drum 1 is uniformly kept at a predetermined level, which is −470 V in this embodiment.

Figure 7:
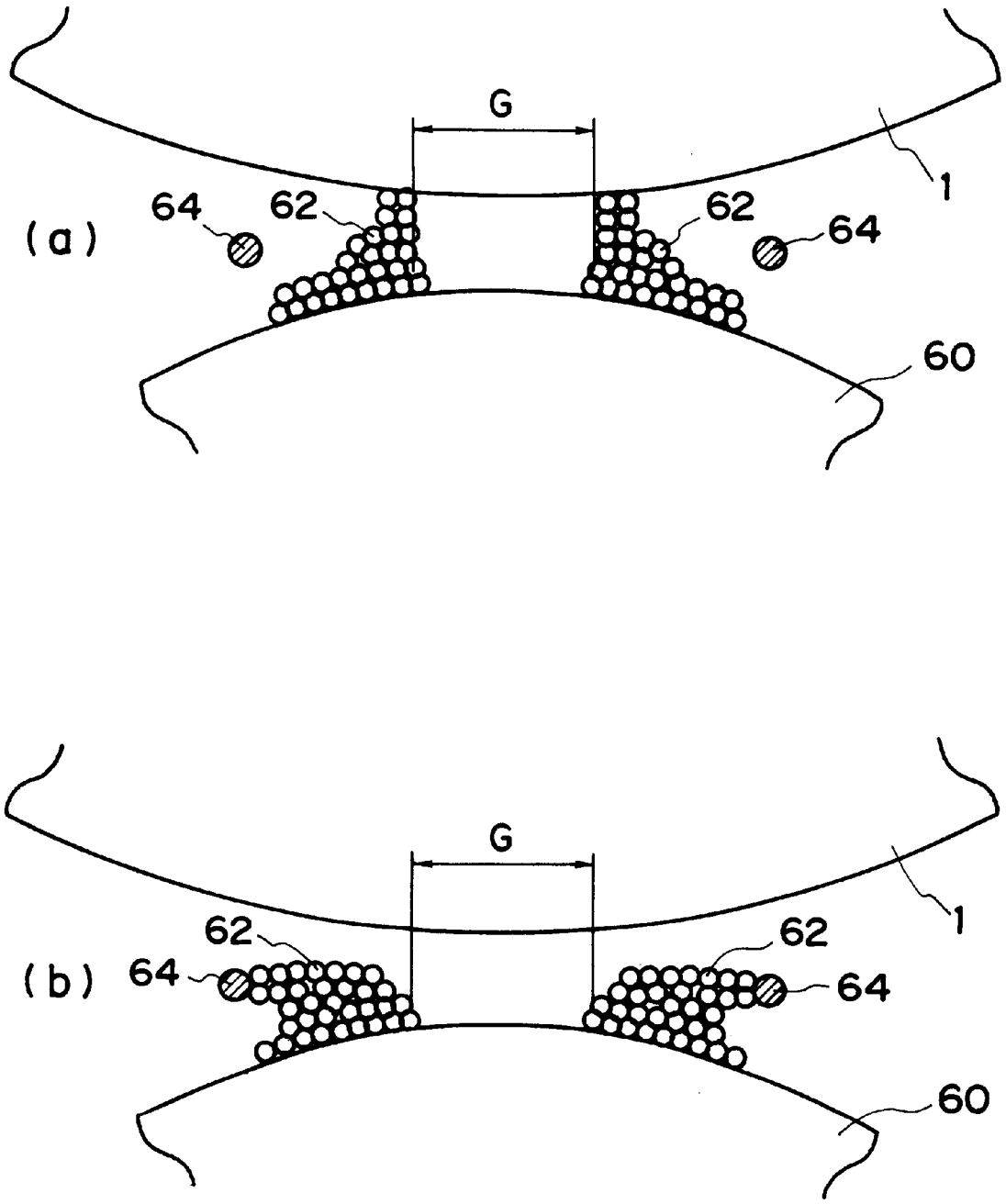
FIGS. 7(*a*) and (*b*) are schematic cross sections of the development nip in another embodiment of the present invention, and depicts the way in which developer is prevented from coming in contact with the photosensitive drum, by applying bias to an electrode.

Further, in this embodiment, an electrode 64 is placed adjacent to both edges of the development nip G, without allowing it to touch either the photosensitive drum 1 or development sleeve 60, as illustrated in FIG. 7(*a*). The electrode 64 in this embodiment is a piece of gold plated tungsten wire having an external diameter of 60$\mu$.

In addition to applying the compound bias (DC+AC) to the aforementioned stationary development sleeves, DC bias which is opposite in polarity to the magnetic carrier is applied to the electrode 64. This DC bias is −400 V in this embodiment. With this arrangement, the developer particles 62 having been moved out of the development nip G are attracted by the electrode 64, and consequently, The contact between the developer particles 62 and the photosensitive drum 1 is completely broken. Thereafter, the DC bias applied to the electrode 64 is turned off, and the image formation for the first color is started.

With this arrangement, by the time the rotation of the photosensitive drum 1 prior to the image formation for the first color, for example, yellow, is completed, the developer particles 62 on the development sleeves 60 of the developing devices 4C–4K for the second color and the colors thereafter are removed from the development nip G, and also are moved out of contact with the photosensitive drum 1. Thereafter, the image formation for the first color is started. Therefore when the toner image for the first color formed on the photosensitive drum 1 passes by the developing devices for the second color and the colors thereafter, the developer particles on the development sleeves for the second color and the colors thereafter do not mix into the toner image for the first color on the photosensitive drum 1; neither do the toner particles from the toner image for the first color mix into the developer on the developing devices for the second and the colors thereafter. Further, the occurrence of image anomaly attributable to the rubbing of the toner image for the first color by the magnetic carrier of the developers for the second color and the colors thereafter can be reliably prevented.

Further, when, for example, the second developing device 4C is the developing device for the first color, DC bias is applied to the electrodes 64 placed, one for one, adjacent to both edges of the development nip G of the first developing device 4Y, during the preliminary rotation of the photosensitive drum 1 to attract the developer particles on the development sleeve 60 of the developing device 4Y toward the electrodes 64. As a result, the electrostatic latent image for the first color formed on the photosensitive drum 1 is prevented from being disturbed by the magnetic carrier particles in the developer on the first developing device 4Y. Thus, the image anomaly attributable to the toner image disturbance by the magnetic carrier can be prevented.

Further, the DC bias, which is opposite in polarity to the magnetic carrier, and is applied to the electrode 64 during the image formation for the first color during the rotation of the photosensitive drum 1 prior to the image formation for the first color, may also be applied during the image formation for the first color like the compound voltage is applied to the stationary development sleeves not only during the preliminary rotation of the photosensitive drum 1, but also during the image formation for the first color. With this arrangement, it is assured that the developer particles 62 which are separated from the development sleeves of the developing devices for the second color and the colors thereafter, are moved out of contact with the photosensitive drum 1 during the image formation for the first color. Therefore, image anomaly such as color mixture or streakiness can be more effectively prevented.

Embodiment 5

As the DC bias to the electrode 64 is turned off, the developer particles 62 which have been kept attracted to the electrodes 64, as illustrated in FIG. 7(*b*), during the rotation of the photosensitive drum 1 prior to the start of each image formation, as well as during the image formation which immediately follows the preliminary rotation of the photosensitive drum 1, returns to the position prior to the application of the DC bias to the electrode 64, as illustrated in FIG. 7(*a*).

However, sometimes, a small amount of the developer particles 62 fails to separate from the electrode 64, remaining attached to the electrode 64. If this phenomenon occurs too many times, the amount of the developer particles 62 attached to the electrode 64 becomes rather large, interfering with the developer attracting ability of the electrode 64, and eventually, the electrode 64 fails to attract the developer particles 62 away from the photosensitive drum 1 to the areas where no contact occurs between the developer particles 62 and the photosensitive drum 1.

Thus, in this embodiment, in order to prevent the above described phenomenon, the following steps are implemented. That is, after the completion of the image formation for the four colors, that is, after the completion of the image formation for the fourth color, the rotation of the development sleeves 60 of all the developing devices is resumed, and the photosensitive drum 1 is idled. During this idling of the photosensitive drum 1, DC bias, which is the same in polarity as the magnetic carrier in the developers, is applied to the rotating development sleeves 60. The DC bias in this embodiment is −250 V. With this arrangement, The developer particles which are adhering to the electrodes 64 are repelled by the electrodes 64, being thereby removed from the electrodes 64. Thus, the performance of the electrode 64 is maintained at a desirable level.

It should be noted here that the developing device for the first color may be any of the developing devices; the order in which the latent images for the four primary colors are developed does not need to be limited to the order described in the preceding embodiments.

Although, in the preceding embodiments, The photosensitive drum 1, or a cylindrical drum with a photosensitive surface layer, is used as the image bearing member, a rotatable endless belt with a photosensitive surface layer may be used as the image bearing member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member for bearing an electrostatic latent image;

a first developing device for developing the electrostatic latent image on said image bearing member;

a second developing device having a movable developer carrying member for carrying toner and carrier, said developer carrying member faced to said image bearing member for effecting development after a first developed image provided by said first developing device passes through a position where said developer carrying member is faced to said image bearing member; and preventing means for forming an alternating electric field between said developer carrying member and said image bearing member, while said second developing device is at rest, to prevent the carrier of said second developing device from rubbing the first developed image.

2. An apparatus according to claim 1, wherein said preventing means applies a bias voltage comprising DC and AC components to said developer carrying member.

3. An apparatus according to claim 2, wherein the DC component has the same polarity as the toner of said first developed image, and has an absolute value which is larger than a potential of an image portion on said image bearing member during first development.

4. An apparatus according to claim 1, wherein said preventing means forms the alternating electric field at least during pre-rotation of said image bearing member prior to formation of the first developed image.

5. An apparatus according to claim 4, wherein said preventing means forms the alternating electric field continuously during the formation of the first developed image.

6. An apparatus according to claim 1, wherein said second developing device effects a contact developing operation wherein chains of the carrier in the form of particles are contacted to said image bearing member, and said preventing means retracts the chains from a developing nip by the alternating electric field.

7. An image forming apparatus comprising:

an image bearing member for bearing an electrostatic latent image;

a first developing device for developing the electrostatic latent image on said image bearing member;

a second developing device having a movable developer carrying member for carrying toner and carrier, said developer carrying member faced to said image bearing member for effecting development after a first developed image provided by said first developing device passes through a position where said developer carrying member is faced to said image bearing member;

a pair of electrodes extended along a longitudinal direction of said developer carrying member at respective sides of a developing position of said second developing device with the developing position therebetween; and preventing means for applying an oscillating voltage to said electrodes, while said second developing device is at rest, to prevent the carrier of said second developing device from rubbing the first developed image.

8. An apparatus according to claim 7, wherein a central value of the oscillating voltage has the same polarity as the toner of said first developing device and has an absolute value which is larger than a potential of an image portion on said image bearing ember during first development.

9. An apparatus according to claim 7, wherein said preventing means applies the oscillating voltage at least during pre-rotation of said image bearing member prior to formation of the first developed image.

10. An apparatus according to claim 9, wherein said preventing means applies the oscillating voltage continuously during the formation of the first developed image.

11. An apparatus according to claim 7, wherein said second developing device effects a contact developing operation wherein chains of the carrier in the form of particles is contacted to said image bearing member, and said preventing means retracts the chains from a developing nip by the oscillating voltage.

12. An image forming apparatus comprising:

an image bearing member for bearing an electrostatic latent image;

a first developing device for developing the electrostatic latent image on said image bearing member;

a second developing device having a movable developer carrying member for carrying toner and carrier, said developer carrying member faced to said image bearing member for effecting development after a first developed image provided by said first developing device passes through a position where said developer carrying member is faced to said image bearing member; and electric field forming means for forming an alternating electric field between said developer carrying member and said image bearing member, while said second developing device is at rest.

13. An image forming apparatus comprising:

an image bearing member for bearing an electrostatic latent image;

a first developing device having a movable developer carrying member for carrying toner and carrier, said developer carrying member faced to said image bearing member;

a second developing device for effecting development after the electrostatic latent image passes through a position where said developer carrying member is faced to said image bearing member; and preventing means for forming an alternating electric field between said developer carrying member and said image bearing member, while said first developing device is at rest, to prevent the carrier of said first developing device from rubbing the electrostatic latent image.

14. An image forming apparatus comprising:

an image bearing member for bearing an electrostatic latent image;

a first developing device having a movable developer carrying member for carrying toner and carrier, said developer carrying member faced to said image bearing member, a second developing device for effecting development after the electrostatic latent image passes through a position where said developer carrying member is faced to said image bearing member; and electric field forming means for forming an alternating electric field between said developer carrying member and said image bearing member, while said first developing device is at rest.

* * * * *

UNITED STATES PATENT AND TRADEMARK OFFICE

CERTIFICATE OF CORRECTION

PATENT NO. : 5,999,777

DATED : December 7, 1999

INVENTOR(S): KOJI MASUDA, ET AL.

It is certified that error appears in the above-identified patent and that said Letters Patent is hereby corrected as shown below:

COLUMN 1:

Line 63, "polential" should read --potential--.

COLUMN 2:

Line 13, "kvpp)," should read --kVpp),--.

Line 28, "drun" should read --drum--.

Line 35, "uses" should read --used--.

Line 63, "4c," should read --4C,--.

COLUMN 3:

Line 60, "arid" should read --and--.

COLUMN 4:

Line 50, "depicts" should read --depict--.

Line 53, "depicts" should read --depict--.

COLUMN 5:

Line 1, "depicts" should read --depict--.

UNITED STATES PATENT AND TRADEMARK OFFICE

CERTIFICATE OF CORRECTION

PATENT NO. : 5,999,777

DATED : December 7, 1999

INVENTOR(S): KOJI MASUDA, ET AL.

It is certified that error appears in the above-identified patent and that said Letters Patent is hereby corrected as shown below:

COLUMN 6:

Line 45, "reconding" should read --recording--.

Line 52, "imagines" should read --image is--.

Line 53, "d" should read --a--.

COLUMN 8:

Line 7, "vectui" should read --vector--.

Line 14, "drum 1" should read --drum 1.--.

COLUMN 13:

Line 9, "ember" should read --member--.

Line 20, "is" should read --are--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*